US011316258B2

(12) United States Patent
Junttila

(10) Patent No.: US 11,316,258 B2
(45) Date of Patent: Apr. 26, 2022

(54) MASSIVE MIMO (MMIMO) ANTENNA WITH PHASE SHIFTER AND RADIO SIGNAL PHASE SYNCHRONIZATION

(71) Applicant: CommScope Technologies LLC, Hickory, NC (US)

(72) Inventor: Mikko Junttila, Oulu (FI)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/176,373

(22) Filed: Feb. 16, 2021

(65) Prior Publication Data

US 2021/0288394 A1 Sep. 16, 2021

Related U.S. Application Data

(60) Provisional application No. 62/987,656, filed on Mar. 10, 2020.

(51) Int. Cl.

| | |
|---|---|
| ***H01Q 3/26*** | (2006.01) |
| ***H01Q 1/24*** | (2006.01) |
| ***H01Q 3/38*** | (2006.01) |

(52) U.S. Cl.

CPC ..... *H01Q 1/246* (2013.01); *H01Q 3/267* (2013.01); *H01Q 3/2682* (2013.01); *H01Q 3/38* (2013.01)

(58) Field of Classification Search

CPC ..... H01Q 1/246; H01Q 3/2682; H01Q 3/267; H01Q 3/38

See application file for complete search history.

(56) References Cited

U.S. PATENT DOCUMENTS

2014/0139373 A1 5/2014 Tseng et al.
2017/0170559 A1* 6/2017 van de Water ..... H01Q 3/36
(Continued)

FOREIGN PATENT DOCUMENTS

WO 2017218396 A1 12/2017
WO 2019120513 A1 6/2019

OTHER PUBLICATIONS

Notification of Transmittal of the International Search Report and the Written Opinion of the International Searching Authority, or the Declaration, in corresponding PCT Application No. PCT/US2021/020603 (dated Jun. 24, 2021).

*Primary Examiner* — Daniel Munoz
(74) *Attorney, Agent, or Firm* — Myers Bigel, P.A.

(57) ABSTRACT

A base station antenna includes a first column of radiating elements containing a first plurality of physical rows of radiating elements, which are collectively operable as a first logical row of radiating elements responsive to a first radio frequency signal (RF1), and (ii) a second plurality of physical rows of radiating elements, which are collectively operable as a second logical row of radiating elements responsive to a second radio frequency signal (RF2). The radiating elements within both the first column and the first logical row include a first plurality of radiating elements responsive to RF1, and a second plurality of radiating elements responsive to a phase delayed version of RF1 generated by a first adjustable phase shifter. A radio frequency (RF) signal generator is provided to adjust a phase of RF2 relative to a phase of RF1, in-sync with a change in a phase delay (and static electric tilt) provided by the first adjustable phase shifter. This in-sync adjustment may support an improvement antenna beam characteristics, including suppression of undesired side-lobes.

20 Claims, 14 Drawing Sheets

(56) References Cited

U.S. PATENT DOCUMENTS

| | | | | |
|---|---|---|---|---|
| 2017/0244157 | A1 | 8/2017 | Muehlbauer et al. | |
| 2019/0319684 | A1 | 10/2019 | Athley et al. | |
| 2020/0411962 | A1* | 12/2020 | Lindmark ..... | H01Q 21/06 |

* cited by examiner

| | Fixed (total) - Normalized | TRX | PS | Total phase (Fixed + TRX + PS) |
|---|---|---|---|---|
| Ele1 | 0.00 | 0.00 | 0.00 | 0.00 |
| Ele2 | 32.00 | 0.00 | 0.00 | 32.00 |
| Ele3 | 64.00 | 0.00 | 0.00 | 64.00 |
| Ele4 | 0.00 | 0.00 | 0.00 | 0.00 |
| Ele5 | 32.00 | 0.00 | 0.00 | 32.00 |
| Ele6 | 64.00 | 0.00 | 0.00 | 64.00 |
| Ele7 | 0.00 | 0.00 | 0.00 | 0.00 |
| Ele8 | 32.00 | 0.00 | 0.00 | 32.00 |
| Ele9 | 64.00 | 0.00 | 0.00 | 64.00 |
| Ele10 | 0.00 | 0.00 | 0.00 | 0.00 |
| Ele11 | 32.00 | 0.00 | 0.00 | 32.00 |
| Ele12 | 64.00 | 0.00 | 0.00 | 64.00 |

| k | PS phasing |
|---|---|
| 0.00 | 155.00 |

TRX2 = 2×k×(PS phasing)

| Fixed (total) - Normalized | TRX | PS | Total phase (Fixed + TRX + PS) |
|---|---|---|---|
| 0.00 | 0.00 | 0.00 | 0.00 |
| 32.00 | 0.00 | 0.00 | 32.00 |
| 64.00 | 0.00 | 0.00 | 64.00 |
| 0.00 | 0.00 | 77.50 | 77.50 |
| 32.00 | 0.00 | 77.50 | 109.50 |
| 64.00 | 0.00 | 77.50 | 141.50 |
| 0.00 | 155.00 | 0.00 | 155.00 |
| 32.00 | 155.00 | 0.00 | 187.00 |
| 64.00 | 155.00 | 0.00 | 219.00 |
| 0.00 | 155.00 | 77.50 | 232.50 |
| 32.00 | 155.00 | 77.50 | 264.50 |
| 64.00 | 155.00 | 77.50 | 296.50 |

| k | PS phasing |
|---|---|
| 0.50 | 155.00 |

TRX2 = 2×k×(PS phasing)

| Fixed (total) - Normalized | TRX | PS | Total phase (Fixed + TRX + PS) |
|---|---|---|---|
| 0.00 | 0.00 | 0.00 | 0.00 |
| 32.00 | 0.00 | 0.00 | 32.00 |
| 64.00 | 0.00 | 0.00 | 64.00 |
| 0.00 | 0.00 | 155.00 | 155.00 |
| 32.00 | 0.00 | 155.00 | 187.00 |
| 64.00 | 0.00 | 155.00 | 219.00 |
| 0.00 | 310.00 | 0.00 | 310.00 |
| 32.00 | 310.00 | 0.00 | 342.00 |
| 64.00 | 310.00 | 0.00 | 374.00 |
| 0.00 | 310.00 | 155.00 | 465.00 |
| 32.00 | 310.00 | 155.00 | 497.00 |
| 64.00 | 310.00 | 155.00 | 529.00 |

| k | PS phasing |
|---|---|
| 1.00 | 155.00 |

TRX2 = 2×k×(PS phasing)

| | Fixed (pre-tilt) | Fixed (cables only) |
|---|---|---|
| Ele1 | 0.00 | 5.00 |
| Ele2 | 36.00 | 0.00 |
| Ele3 | 0.00 | 72.50 |
| Ele4 | 36.00 | 67.50 |
| Ele5 | 0.00 | 110.00 |
| Ele6 | 36.00 | 105.00 |
| Ele7 | 0.00 | 5.00 |
| Ele8 | 36.00 | 0.00 |
| Ele9 | 0.00 | 42.50 |
| Ele10 | 36.00 | 37.50 |
| Ele11 | 0.00 | 95.00 |
| Ele12 | 36.00 | 90.00 |

+

| TRX | PS | Sum phases | k | PS phasing |
|---|---|---|---|---|
| 0.00 | 95.00 | 100.00 | 1.00 | 95.00 |
| 0.00 | 95.00 | 131.00 | | |
| 0.00 | 47.50 | 120.00 | | |
| 0.00 | 47.50 | 151.00 | | |
| 0.00 | 0.00 | 110.00 | | |
| 0.00 | 0.00 | 141.00 | | |
| 0.00 | 95.00 | 100.00 | | |
| 0.00 | 95.00 | 131.00 | | |
| 0.00 | 47.50 | 90.00 | | |
| 0.00 | 47.50 | 121.00 | | |
| 0.00 | 0.00 | 95.00 | | |
| 0.00 | 0.00 | 126.00 | | |

| TRX | PS | Sum phases | k | PS phasing |
|---|---|---|---|---|
| 0.00 | 47.50 | 52.50 | 0.50 | 95.00 |
| 0.00 | 47.50 | 83.50 | | |
| 0.00 | 47.50 | 120.00 | | |
| 0.00 | 47.50 | 151.00 | | |
| 0.00 | 47.50 | 157.50 | | |
| 0.00 | 47.50 | 188.50 | | |
| 142.50 | 47.50 | 195.00 | | |
| 142.50 | 47.50 | 226.00 | | |
| 142.50 | 47.50 | 232.50 | | |
| 142.50 | 47.50 | 263.50 | | |
| 142.50 | 47.50 | 285.00 | | |
| 142.50 | 47.50 | 316.00 | | |

| TRX | PS | Sum phases | k | PS phasing |
|---|---|---|---|---|
| 0.00 | 0.00 | 5.00 | 0.00 | 95.00 |
| 0.00 | 0.00 | 36.00 | | |
| 0.00 | 47.50 | 120.00 | | |
| 0.00 | 47.50 | 151.00 | | |
| 0.00 | 95.00 | 205.00 | | |
| 0.00 | 95.00 | 236.00 | | |
| 285.00 | 0.00 | 290.00 | | |
| 285.00 | 0.00 | 321.00 | | |
| 285.00 | 47.50 | 375.00 | | |
| 285.00 | 47.50 | 406.00 | | |
| 285.00 | 95.00 | 475.00 | | |
| 285.00 | 95.00 | 506.00 | | |

*Fig. 7C*

MASSIVE MIMO (MMIMO) ANTENNA WITH PHASE SHIFTER AND RADIO SIGNAL PHASE SYNCHRONIZATION

REFERENCE TO PRIORITY APPLICATION

The present invention claims priority to U.S. Provisional Application Ser. No. 62/987,656, filed Mar. 10, 2020, the disclosure of which is hereby incorporated herein by reference.

FIELD OF THE INVENTION

The present invention relates to radio communication systems and, more particularly, to multi-beam base station antennas (BSAs) utilized in cellular and other communication systems.

BACKGROUND

The beam shape of massive MIMO (mMIMO) beamforming antennas can be controlled best by using adjustable radio frequency (RF) signal phases and amplitudes for each radiating element. However, this approach will typically add significant product cost if the signal phases and amplitudes are controlled using digital beamforming techniques, which typically require separate radio control for each radiating element within the mMIMO antenna. To reduce product cost, radiating elements can be paired; however, such pairing can lead to deteriorated beam shape, including unwanted sidelobes. Moreover, when beams are directed in different directions, phase errors will typically occur in relation to an optimum required beam shape. One example of phase error generation is illustrated by the non-massive MIMO antenna 10*a* of FIG. 1A, which includes a pair of sub-groups of radiating elements 12 therein, which are responsive to a single radio signal. As shown, this radio signal is provided to a pair of conventional 1-to-3 (1 input, 3 outputs) phase shifters 14*a*, 14*b*. These phase shifters 14*a*, 14*b* are set to provide equivalent phase generation to two sub-groups of three radiating elements. As will be understood by those skilled in the art, the equivalent settings on phase shifters 14*a*, 14*b* will enable the generation of respective beams at equivalent down-tilt angles. Nonetheless, a phase error will remain between the wavefronts of the respective beams. And, as shown by the antenna 10*b* of FIG. 1B, the substitution of a pair of radios (Radio 1, Radio 2) for the single radio in FIG. 1A will not necessarily reduce a degree of phase shift error.

In contrast, the non-massive MIMO antenna 20 of FIG. 2 can be configured to provide a uniform beam wavefront using digital beamforming techniques, which includes electrically coupling separate radios (Radio 1-Radio 6) to each of the radiating elements 12.

SUMMARY

A base station antenna, such as a massive MIMO (mMIMO) antenna includes a first column of radiating elements. This first column is arranged to include: (i) a first plurality of physical rows of radiating elements, which are collectively operable as a first logical row of radiating elements responsive to a first radio frequency signal (RF1), and (ii) a second plurality of physical rows of radiating elements, which are collectively operable as a second logical row of radiating elements responsive to a second radio frequency signal (RF2). The radiating elements within both the first column and the first logical row include: a first plurality of radiating elements responsive to RF1, and a second plurality of radiating elements responsive to a phase delayed version of RF1. This phase delayed version of RF1 is generated by a first adjustable phase shifter. A radio frequency (RF) signal generator is also provided. This RF signal generator is configured to adjust a phase of RF2 relative to a phase of RF1, in response a change in a phase delay provided by the first adjustable phase shifter. In particular, the RF signal generator adjusts the phase of RF2 relative to RF1 to thereby cause a change static electric tilt associated with the first column of radiating elements.

In some embodiments of the invention, the RF signal generator is configured to adjust the phase of RF2 relative to RF1 in response to receiving a feedback signal indicating an updated phase delay state of the first adjustable phase shifter. The RF signal generator may include a radio and baseband processor coupled to the radio, and the feedback signal may be provided to the baseband processor. The radio may generate RF2 having the adjusted phase, in response to an updated control signal generated by the baseband processor.

According to additional embodiments of the invention, the phase of RF2 relative to RF1 is a function of: (i) a programmable tilt factor "k", which specifies a desired degree of the static electric tilt associated with said at least a first column of radiating elements, (ii) a phasing coefficient "$P_c$", which specifies a magnitude of a phase delay that can be provided by the first adjustable phase shifter; and (iii) a multiplier "M", having a magnitude greater than one.

BRIEF DESCRIPTION OF THE DRAWINGS

FIG. 7C illustrates tables of pre-tilt, phase shifter and signal phases that support 1° (for k=1), 6° (for k=0.5) and 11° (for k=0) static electric down-tilt states in the column of radiating elements of FIG. 7A, according to an embodiment of the invention.

DETAILED DESCRIPTION

Figure 1A:
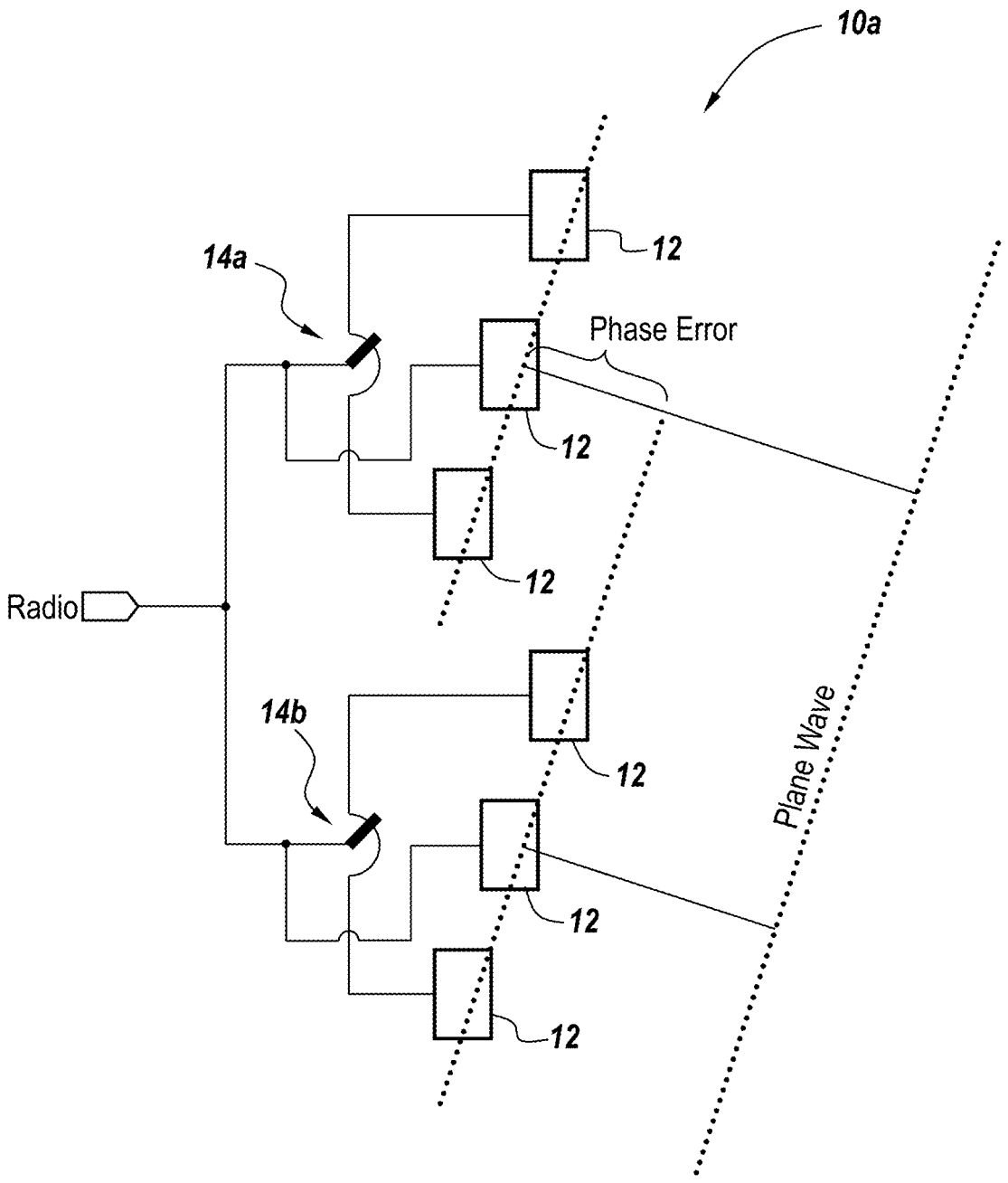
Fig. 1A (Prior Art)
FIG. 1A is a block electrical schematic of a conventional non-massive MIMO antenna having a pair of sub-groups of radiating elements therein, which are responsive to a single radio signal.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1B:
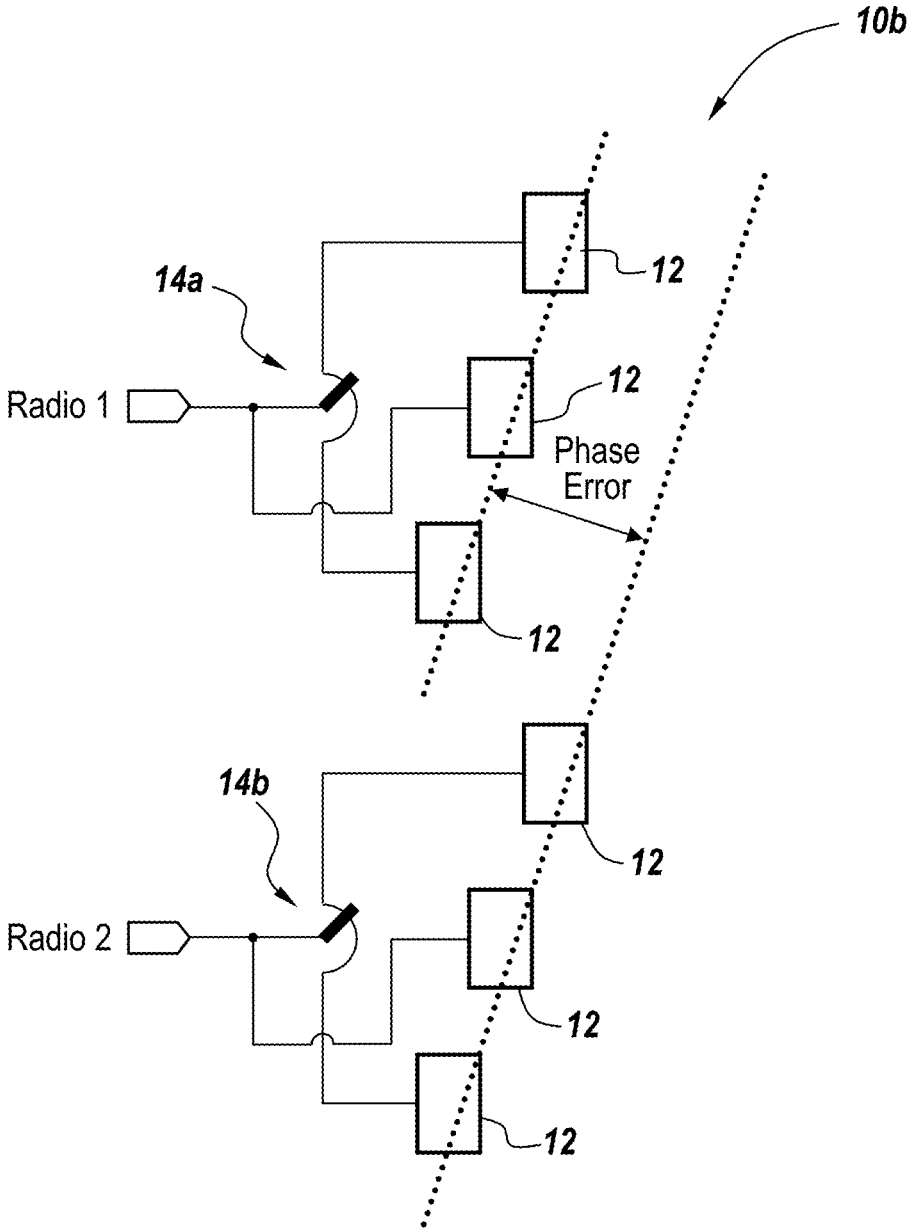
Fig. 1B (Prior Art)
FIG. 1B is a block electrical schematic of a conventional non-massive MIMO antenna having a pair of sub-groups of radiating elements therein, which are responsive to a respective pair of radio signals.
Figure 2:
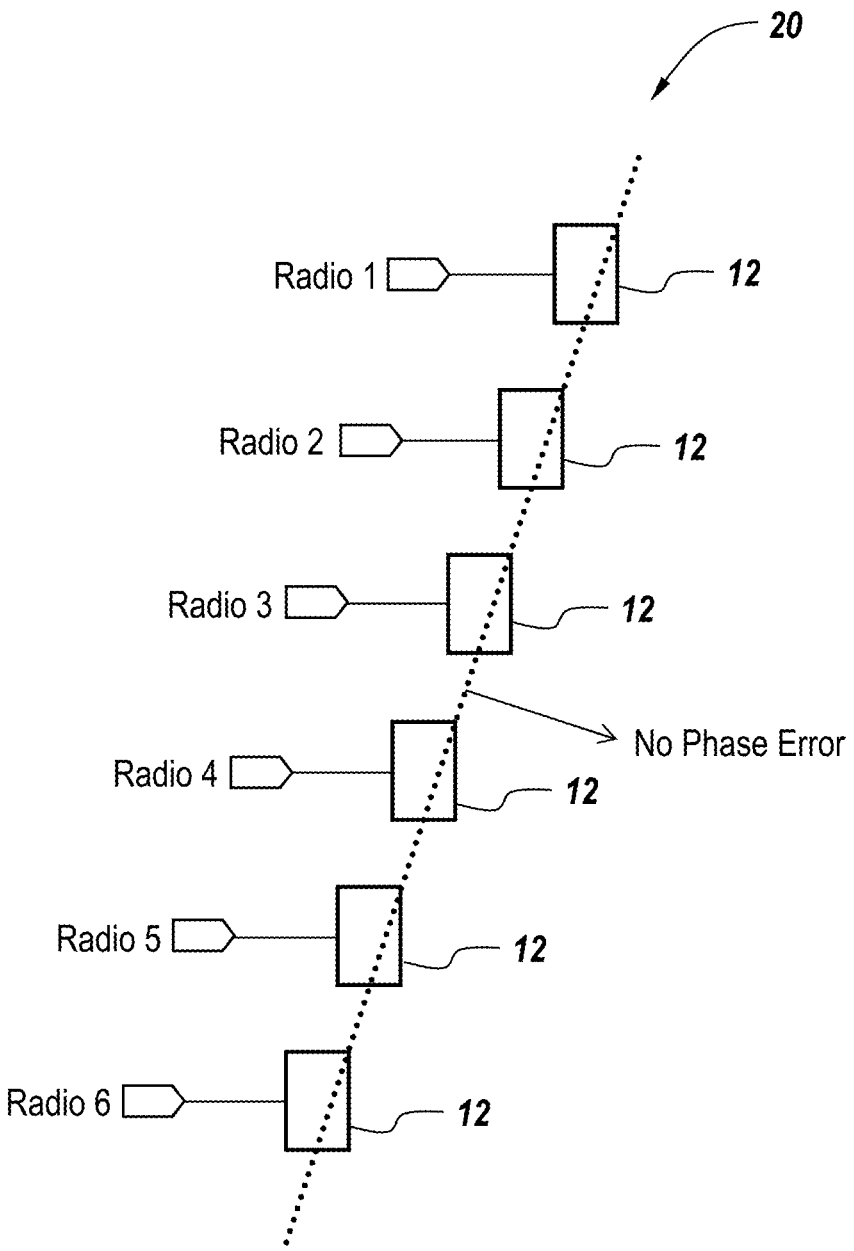
Fig. 2 (Prior Art)
FIG. 2 is a block electrical schematic of a conventional full-digital non-massive MIMO having an array of radiating elements therein, which are responsive to respective radio signals.
Figure 3:
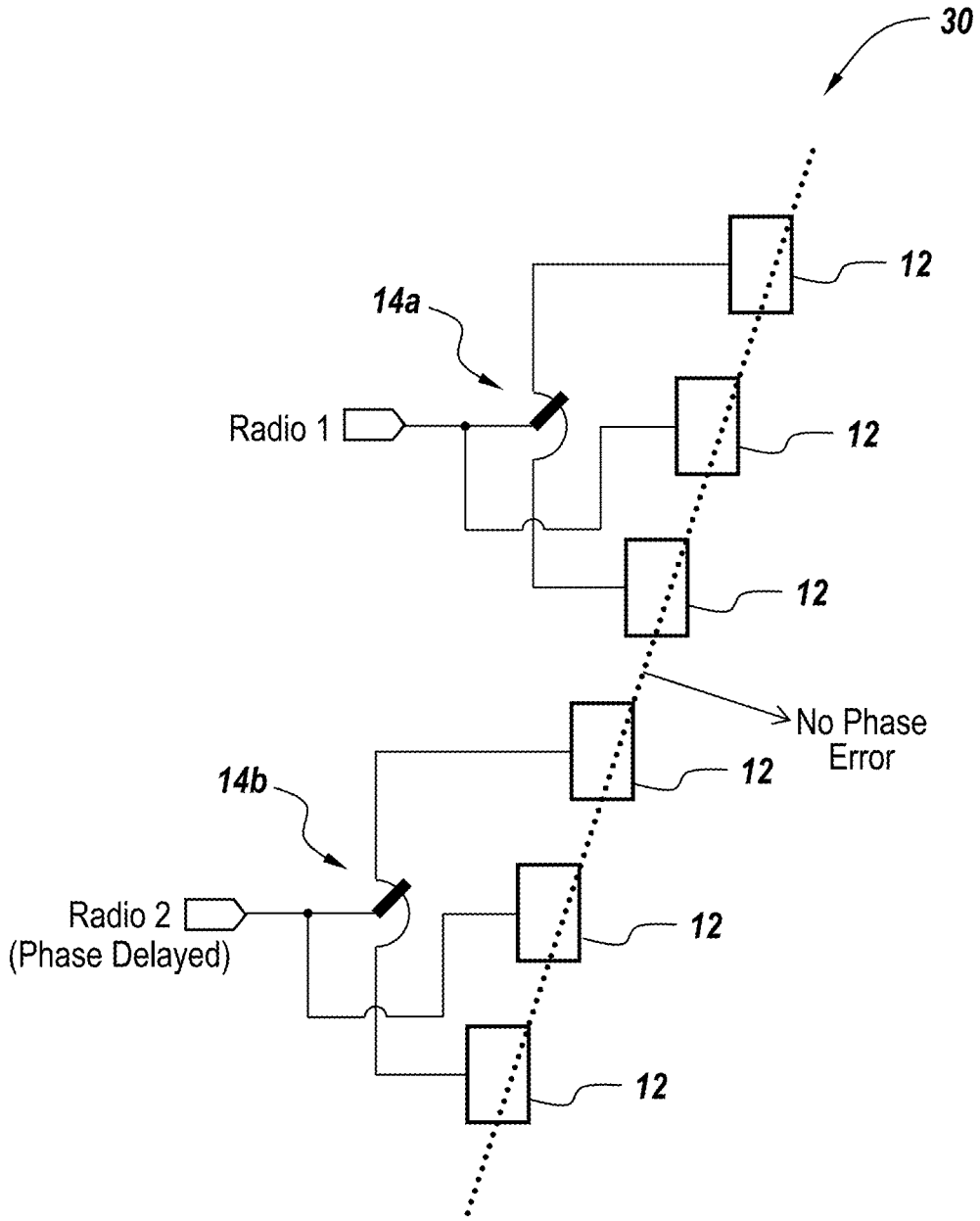
FIG. 3 is a block electrical schematic of a non-massive MIMO antenna having a pair of sub-groups of radiating elements therein, which are responsive to a respective pair of radio signals, according to an embodiment of the invention.

Referring now to FIG. 3, a non-massive MIMO antenna 30 having a pair of sub-groups of radiating elements 12 is illustrated as being responsive to a pair of radios (Radio 1, Radio 2), which drive respective 1-to-3 phase shifters 14*a*, 14*b*, as shown. This MIMO antenna 30 is similar to the antenna 10*b* of FIG. 1B, however, the radio frequency (RF) signal generated by the second radio, Radio 2, is sufficiently phased delayed relative to the phase of the first radio, Radio 1, to thereby provide a uniform beam wavefront, but without the requirement of individual radios as illustrated by FIG. 2.

Figure 4A:
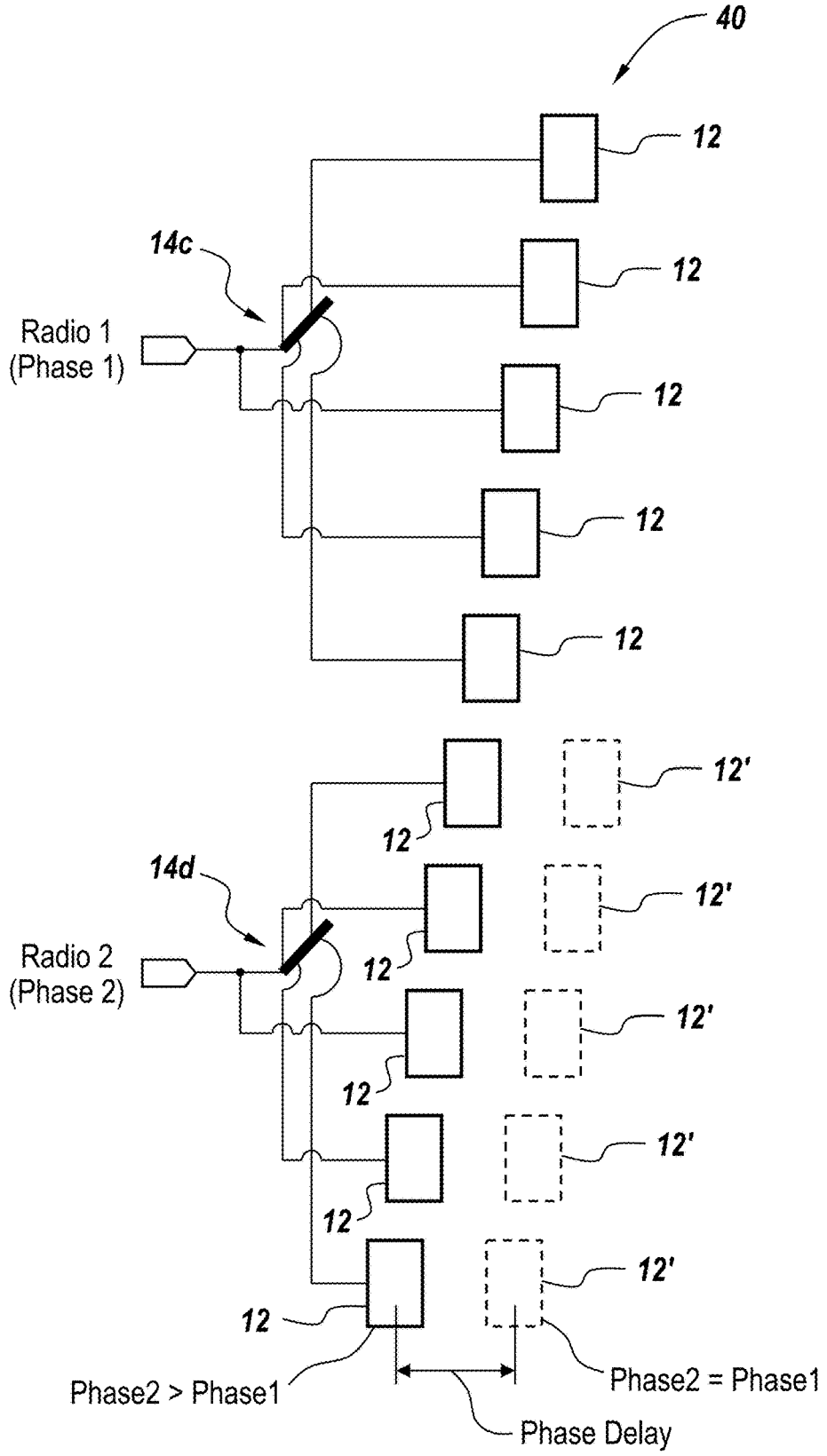
FIG. 4A is a block electrical schematic of a non-massive MIMO antenna having a pair of sub-groups of radiating elements therein, which are responsive to a respective pair of radio signals and operable in a full-array mode, according to an embodiment of the invention.

This uniform beam wavefront is also achievable using the non-massive MIMO antenna 40 of FIG. 4A. This antenna 40 utilizes five (5) radiating elements per sub-group, and a pair of equally-set 1-to-5 phase shifters 14*c*, 14*d*, to operate in a full-array mode that supports a single down-tilt beam angle. In this mode, all ten radiating elements 12 are controllably phase delayed to achieve a uniform beam wavefront when the phase of radio 2, Phase 2, is sufficiently greater than the phase of radio 1, Phase 1. As illustrated by the location of the highlighted radiating elements 12', the built-in pre-tilt phase delays associated with the elements 12' are not sufficient to yield a uniform beam wavefront when Phase 2=Phase 1.

Figure 4B:
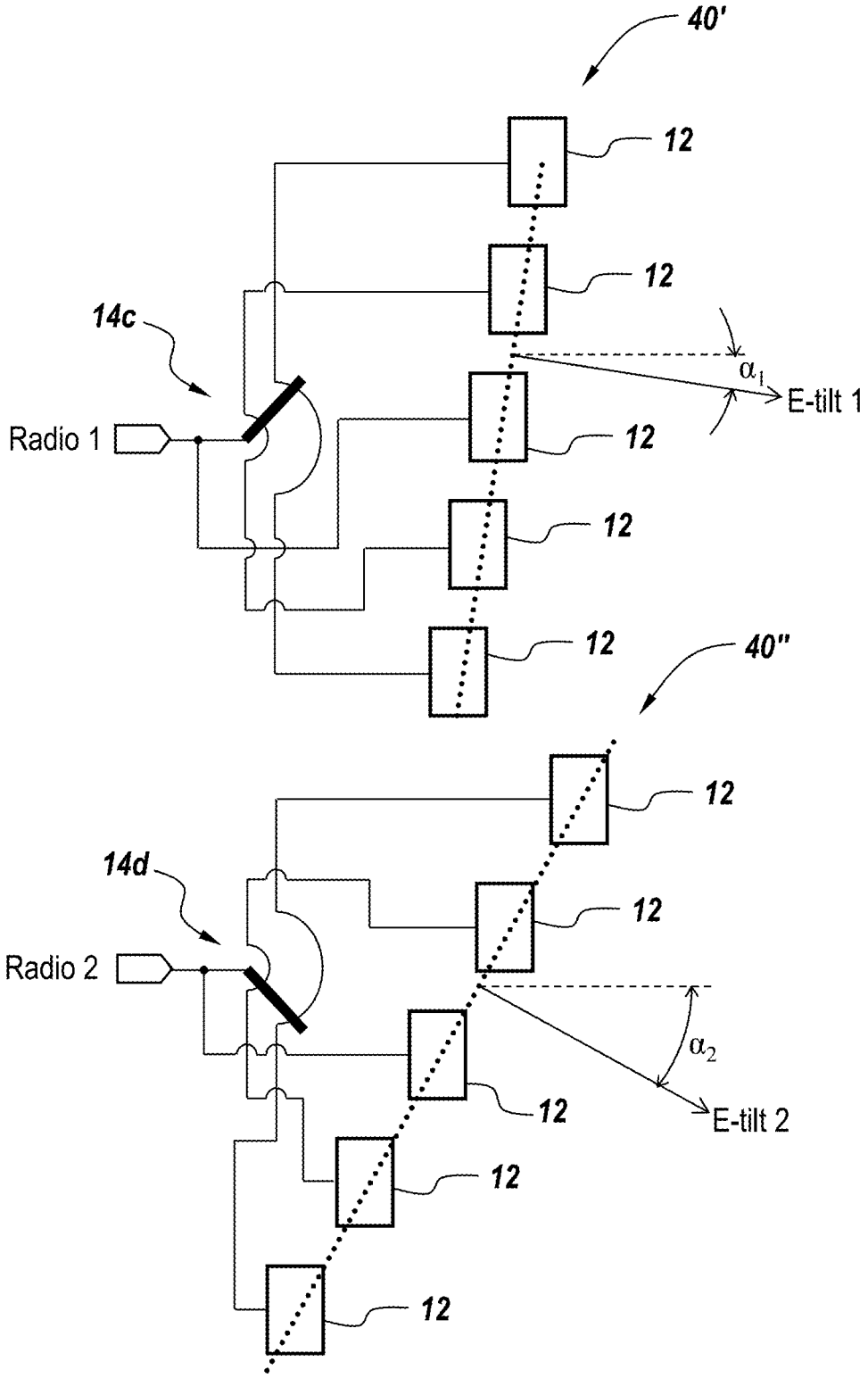
FIG. 4B is a block electrical schematic of a non-massive MIMO antenna having a pair of sub-groups of radiating elements therein, which are responsive to a respective pair of radio signals and operable in a split-array mode, according to an embodiment of the invention.

The MIMO antenna 40 of FIG. 4A may also be configured to support a split-mode of operation, which yields two separate beams at spaced-apart elevation down-tilt angles $\alpha_1$, $\alpha_2$, where $\alpha_2>\alpha_1$. As shown by FIG. 4B, the first beam, at E-tilt 1, is generated by a first sub-group 40' of radiating elements 12, which are responsive to Radio 1. And, the second beam, at E-tilt 2, is generated by a second sub-group 40" of radiating elements 12, which are responsive to Radio 2. The setting of $\alpha_2$ relative to $\alpha_1$ to achieve a greater down-tilt is established by setting the phase shifters 14*c*, 14*d* to different positions, as shown.

Figure 5A:
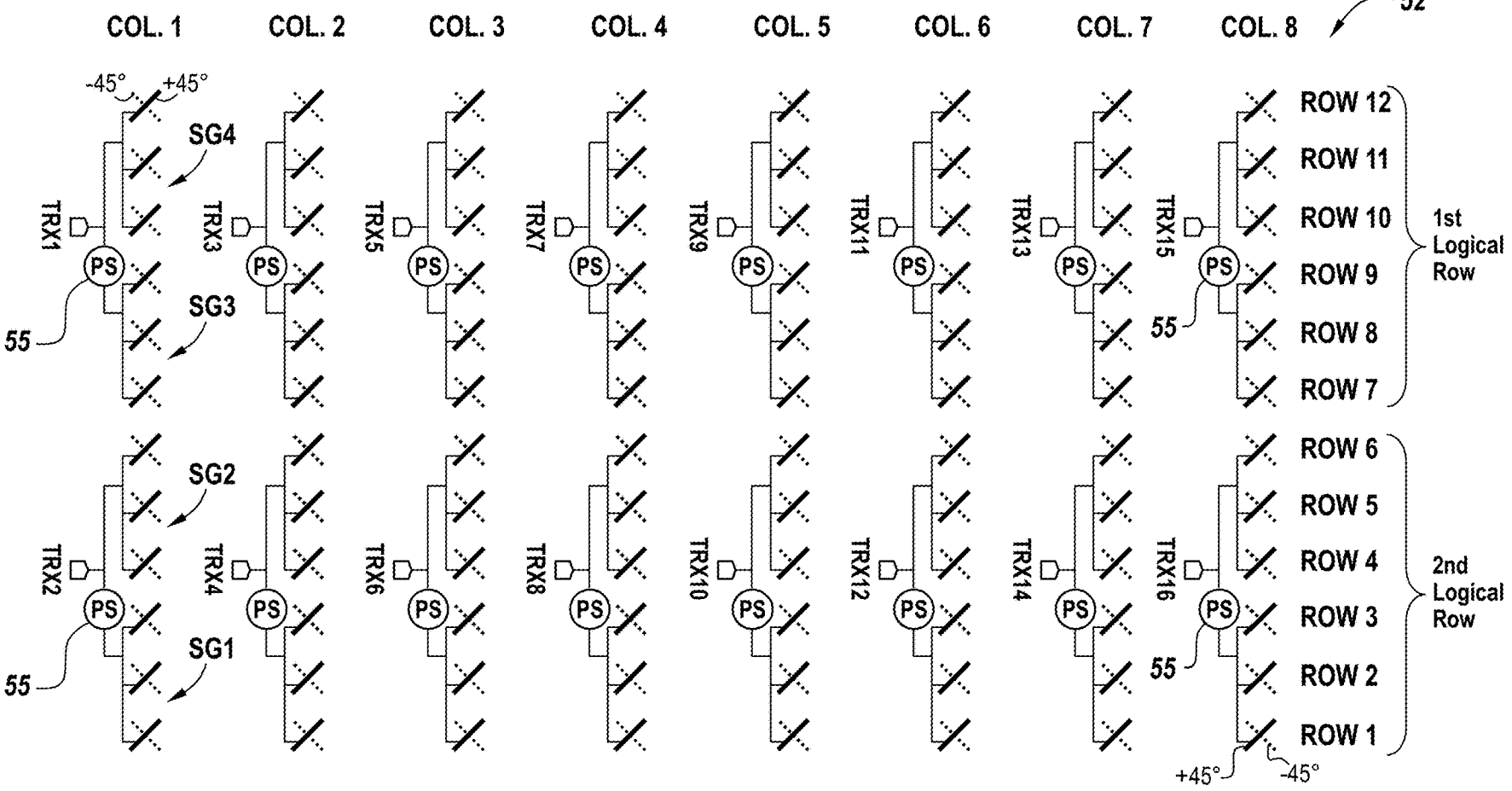
FIG. 5A is an electrical schematic of a massive MIMO (mMIMO) antenna array having a plurality of rows (12), and a plurality of columns (8) of radiating elements, which are arranged into four three-element sub-groups (SG1, SG2, SG3 and SG4) per column, according to an embodiment of the invention.
Figure 5B:
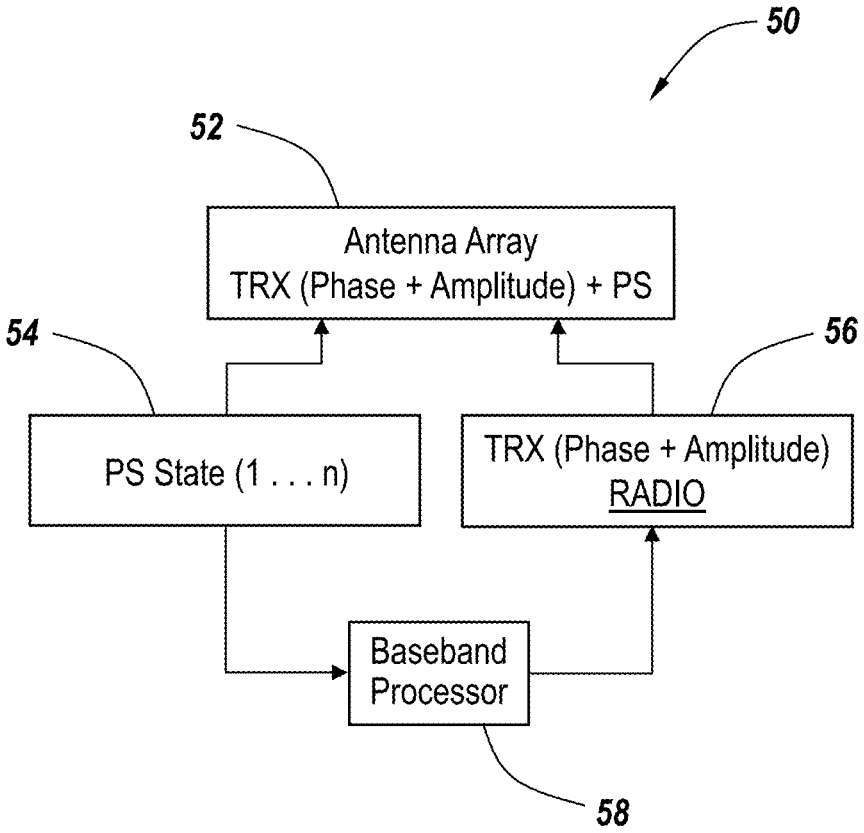
FIG. 5B is a block diagram of an mMIMO antenna, which illustrates components that support phase shifter and radio signal phase synchronization, according to an embodiment of the invention.

Referring now to FIGS. 5A-5B, a massive MIMO (mMIMO) antenna 50 according to another embodiment of the invention is illustrated as including an antenna array 52, which is arranged as an 8 column by 12 row array of cross-polarized (+45°/−45°) dipole radiating elements. As shown by column 1 of the array 52, each of the columns is configured to have four sub-groups of radiating elements, which are identified as SG1, spanning physical rows 1-3, SG2, spanning physical rows 4-6, SG3, spanning physical rows 7-9, and SG4, spanning physical rows 10-12.

In addition, the paired sub-groups SG3, SG4 (across the eight columns) are configured as a first logical row of radiating elements, which is responsive to the following "odd" radio frequency (RF) signals: TRX1, TRX3, TRX5, . . . , TRX15, whereas the paired sub-groups SG1, SG2 (across the eight columns) are configured as a second logical row of radiating elements, which is responsive to the following "even" radio frequency (RF) signals: TRX2, TRX4, TRX6, . . . , TRX16. Each of the paired sub-groups of radiating elements includes a corresponding phase shifter (PS) 55, connected as illustrated.

In the embodiment of FIG. 5A, the phase shifter 55 is illustrated as a 1-to-1 adjustable phase shifter, which receives an RF signal (TRXn) at its input terminal and produces a phase-delayed version of the RF signal at its output terminal. Based on this configuration, the radiating elements in sub-group SG3 receive a phase-delayed version of the RF signal provided to sub-group SG4. Similarly, the radiating elements in sub-group SG1 receive a phase-delayed version of the RF signal provided to sub-group SG2. As explained more fully hereinbelow with respect to FIGS. 6A-6C, each of the radiating elements within a sub-group has a respective fixed, pre-tilt, phase delay associated therewith. In addition, according to other embodiments of the invention, the illustrated 1-to-1 phase shifter 55 may be replaced with an adjustable 1-to-2 phase shifter (not shown), which receives an RF signal at its input terminal and produces two unequal phase-delayed versions of the RF signal at its first and second output terminals, which are electrically coupled to respective sub-groups ((SG1, SG2), (SG3, SG4)). These 1-to-1 and 1-to-2 phase shifter embodiments may utilize wiper-type (or slider-type) adjustment mechanisms, for example, that support the adjustment (e.g., by user-controlled remote electric tilt (RET) motor) of a phase delay provided by the phase shifter.

FIG. 5B illustrates a block diagram of a mMIMO antenna 50, which includes: (i) the antenna array 52 of FIG. 5A, (ii) a radio 56, which generates (amplitude, phase) the RF transmission signals TRXn described herein, (iii) a baseband processor 58 that manages the functions of the radio 56, and (iv) a phase shifter state signal generator 54. This signal generator 54 produces control signals to the antenna array 52 that enables conventional remote electric tilt motor (RET) operations to be performed therein (e.g., via AISG) to adjust the magnitude of the phase delays provided by the phase shifters 55. The state signal generator 54 also produces control signals, in the form of feedback, that inform the baseband processor 58 of the phase shifter status (e.g., shifter position). This information is then transmitted from the baseband processor 58 to the radio 56, so that the radio can update the appropriate phases of the RF transmission signals TRXn in-sync with the updated phase shifter status (i.e., updated phase delay state of PS 55), as described hereinbelow with respect to FIGS. 6A-6C and 7A-7C.

Figure 6A:
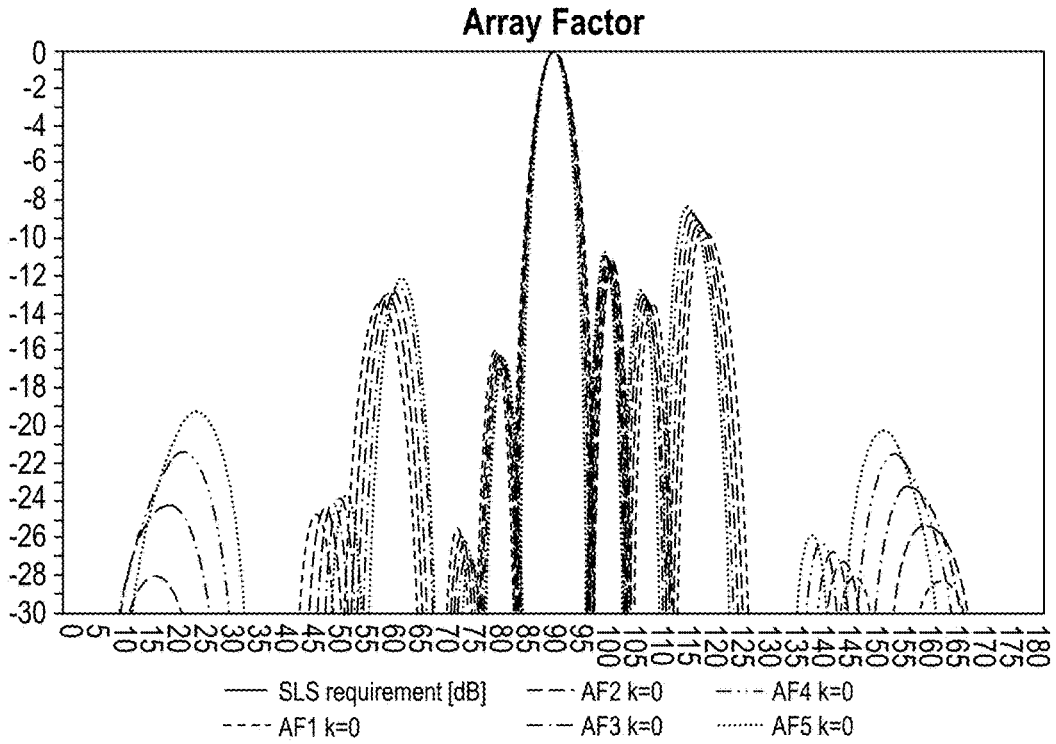
FIG. 6A illustrates a shape of an antenna beam in an elevation plane and a table of pre-tilt, phase shifter and signal phases that support a 1° static electric down-tilt (for k=0) using the antenna of FIGS. 5A-5B, according to an embodiment of the invention.
Figure 6B:
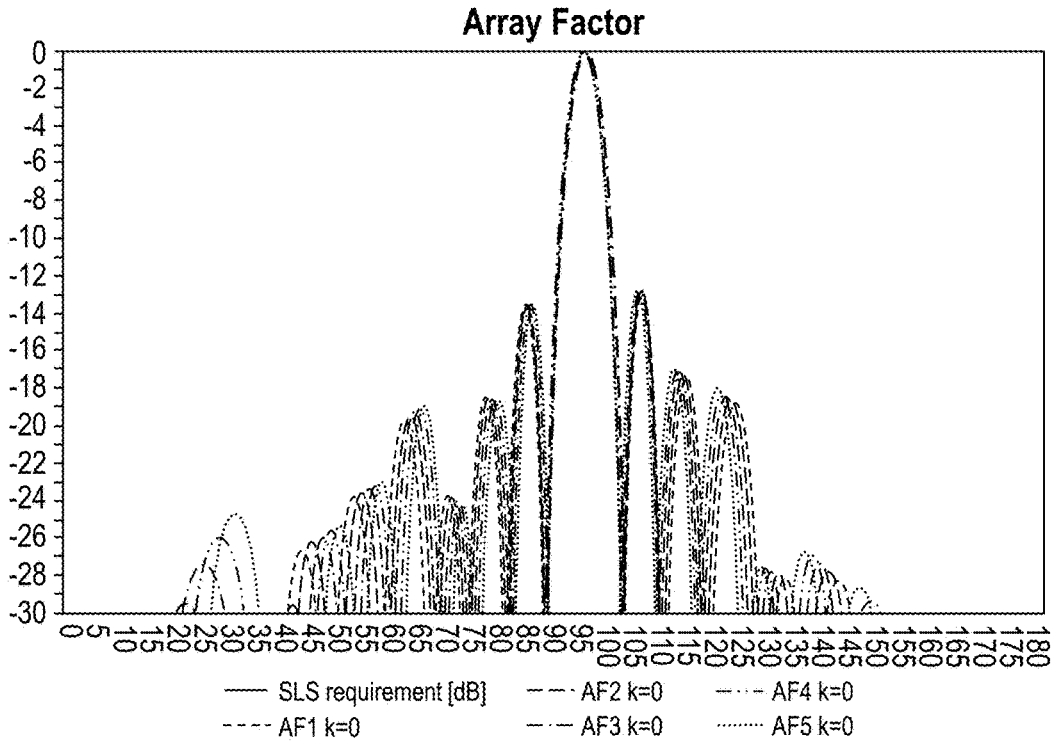
FIG. 6B illustrates a shape of an antenna beam in an elevation plane and a table of pre-tilt, phase shifter and signal phases that support a 6° static electric down-tilt (for k=0.5) using the antenna of FIGS. 5A-5B, according to an embodiment of the invention.
Figure 6C:
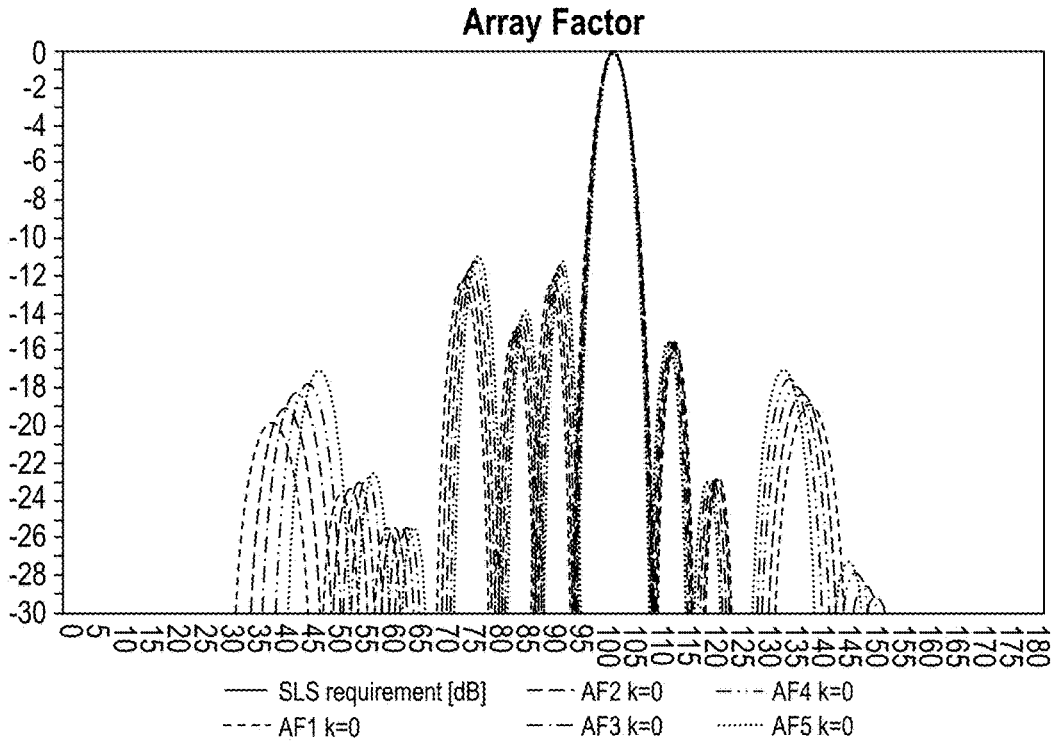
FIG. 6C illustrates a shape of an antenna beam in an elevation plane and a table of pre-tilt, phase shifter and signal phases that support a 11° static electric down-tilt (for k=1.0) using the antenna of FIGS. 5A-5B, according to an embodiment of the invention.

As shown by FIGS. 6A-6C, one method of operating the mMIMO antenna 50 of FIGS. 5A-5B to improve antenna beam characteristics (e.g., sidelobe suppression) includes operations to synchronize changes in radio signal TRxn phase to changes in phase shifter states. These operations are undertaken in response to user-controlled static electric down-tilt angle adjustments. Although not shown with respect to the embodiment of FIGS. 5A-5B, analogous operations to those described herein may also be utilized to provide a desired static electric tilt in an azimuth plane using row-based (versus column-based) phase shifters. In addition, the phase delays described herein correspond to signals having a specific frequency (e.g., 3.8 GHz).

In FIG. 6A, an antenna beam may be generated by the mMIMO antenna 50 to have a 1° static electric down-tilt (for k=0) in an elevation plane, which spans a 0°-180° arc, where 91° along the arc corresponds to a 1° down-tilt (i.e., −1° tilt relative to the horizon). In this example, the phase shifter 55 is assumed to support a maximum phase shift of 155° (i.e., PS phasing=155°). Thus, if the phase shifter 55 is a wiper-type phase shifter that sweeps a 180° arc, then a wiper position of 0° along the arc may provide a 0° phase shift, a wiper position of 90° along the arc may provide a 77.5° phase shift, and a wiper position of 180° along the arc may provide a 155° phase shift, for example.

Referring now to the table in FIG. 6A, the references "Ele1" to "Ele12" correspond to radiating elements 1 through 12. With reference to the leftmost column (i.e., Col. 1) of radiating elements in FIG. 5A, Ele1 corresponds to the uppermost +45° radiating element in row 12, whereas Ele12 corresponds to the lowermost radiating element +45° in row 1. Thus, sub-group SG4 of radiating elements includes Ele1-Ele3, sub-group SG3 of radiating elements includes Ele4-Ele6, sub-group SG2 of radiating elements includes Ele7-Ele9 and sub-group SG1 of radiating elements corresponds includes Ele10-Ele12. Also shown in the table of FIG. 6A, a column showing fixed, pre-tilt, phase delays (as normalized), which are associated with the radiating elements Ele1-Ele12. A 0° pre-tilt phase delay is associated with Ele1, Ele4, Ele7 and Ele10, whereas a 32° pre-tilt phase delay is associated with Ele2, Ele5, Ele8 and Ele11, and a 64° pre-tilt phase delay is associated with Ele3, Ele6, Ele9 and Ele12. The rightmost column in the table represents the "total" phase delays associated with each of the radiating elements. This total phase delay represents a summation of: (i) the fixed, pre-tilt, phase delay, (ii) any phase-shifter added phase delay (PS), and (iii) any radio signal phase delay (i.e., TRXn phase), which is advantageously synchronized (via the baseband processor 58) to changes in the phase-shifter phase delay PS, to thereby suppress undesirable sidelobe beam generation.

Because the table of FIG. 6A corresponds to the case where the programmable tilt factor "k" equals 0, the delays provided by the phase shifters 55 in column 1 of FIG. 5A are set to zero; and the relative phases of radio signal TRX1, associated with elements Ele1-Ele6 in a first logical row, and radio signal TRX2, associated with elements Ele7-Ele12 in a second logical row, are also set to zero. In particular, the phase of TRX2 relative to TRX1 is synchronized to the performance of phase adjustments to the phase shifters 55 in accordance with the following relationship: TRX2=2×k×(PS phasing), where "k" is the programmable tilt factor "k" in a range from 0-to-1, which specifies a desired degree of the static electric tilt associated with the column of radiating elements, and "PS phasing" is equivalent to a phasing coefficient "$P_c$", which specifies a maximum user-adjustable phase delay that can be provided by the adjustable phase shifter 55. Thus, as shown by the table, when the phase shifters 55 are set to provide a 0° phase delay, to achieve a 1° static electric down-tilt (i.e. k=0), TRX2=TRX1=0°.

In FIG. 6B, an antenna beam may be generated by the mMIMO antenna 50 to have a 6° static electric down-tilt (for k=0.5), which corresponds to a 96° beam angle in the corresponding graph. This 6° down-tilt also corresponds to a phase shifter phase delay of 77.5° (i.e., 0.5×155°). Thus, based on the following relationship: TRX2=2×0.5×(155°), and as shown by the table in FIG. 6B, an adjustment of the phase shifter 55 to provide a 77.5° phase delay and a desired static down-tilt will be communicated to the baseband processor 58 of FIG. 5B. This communication will also induce an in-sync update to the phase of radio signal TRX2 relative to radio signal TRX1, where the relative phase of TRX2 equals 155°.

Likewise, as shown by FIG. 6C, an antenna beam may be generated by the mMIMO antenna 50 to have an 11° static electric down-tilt (for k=1), which corresponds to a 101° beam angle in the corresponding graph. This 11° down-tilt also corresponds to a phase shifter phase delay of 155° (i.e., 1.0×155°). Thus, based on the following relationship:

TRX2=2×1.0×(155°), and as shown by the table in FIG. 6C, an adjustment of the phase shifter 55 to provide a 155° phase delay will be communicated to the baseband processor 58 of FIG. 5B and will induce an in-sync update to the phase of radio signal TRX2 relative to radio signal TRX1, where the relative phase of TRX2 equals 310°.

Figure 7A:
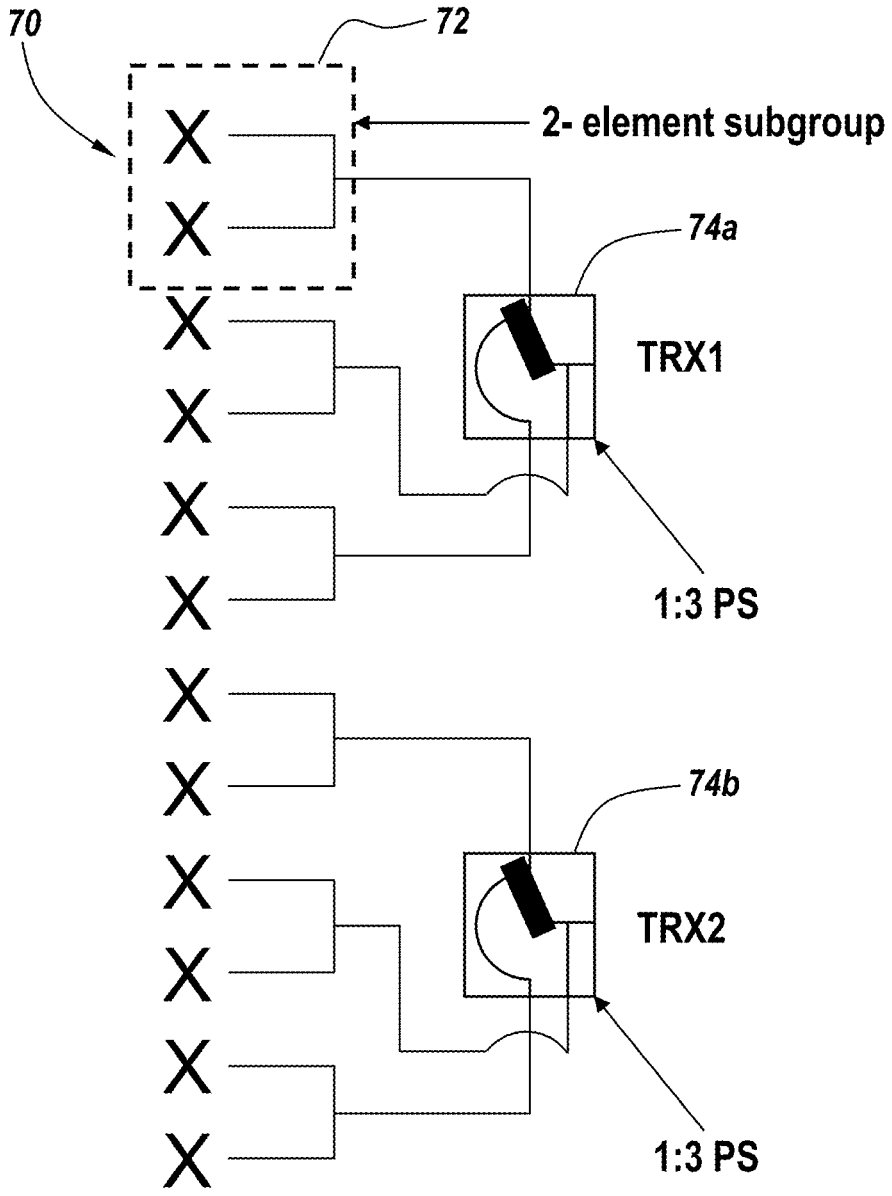
FIG. 7A is an electrical schematic of a column of radiating elements within a massive MIMO (mMIMO) antenna, which is arranged into six two-element sub-groups of radiating elements, according to an embodiment of the invention.
Figure 7B:
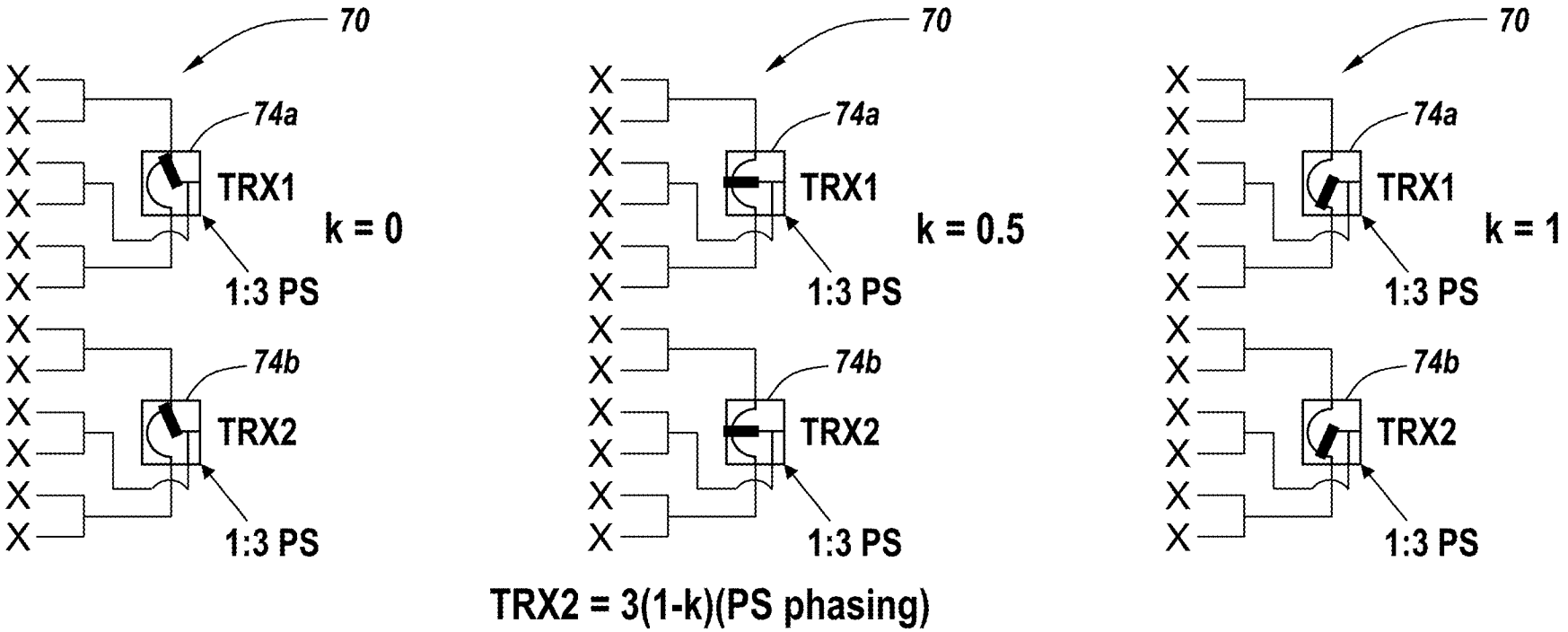
FIG. 7B illustrates the column of radiating elements of FIG. 7A, as configured to support three different static electric down-tilt states: 1° (for k=1), 6° (for k=0.5) and 11° (for k=0), according to an embodiment of the invention.

Referring now to FIG. 7A, an electrical schematic of a column 70 of radiating elements is illustrated as include six, two-element, subgroups 72 of radiating elements. As shown, the top three subgroups 72 of radiating elements are electrically coupled to respective outputs of a 1-to-3 phase shifter 74*a*, which is shown as a wiper-type phase shifter responsive to radio signal TRX1. Similarly, the bottom three subgroups 72 of radiating elements are electrically coupled to respective outputs of a 1-to-3 phase shifter 74*b*, which receives radio signal TRX2. In FIG. 7B, three specific paired-states of the phase shifters 74*a*, 74*b* are shown. On the left side of FIG. 7B, for k=0 (11° down-tilt), the wipers within the phase shifters 74*a*, 74*b* are set to a first state. In the middle of FIG. 7B, for k=0.5 (6° down-tilt), the wipers are set to a second state. And, on the right side of FIG. 7B, for k=1 (1° down-tilt), the wipers are set to a third state. For purposes of this example, it is assumed that the maximum phase delay supported by the phase shifters 74*a*, 74*b* is 95° (e.g., at 3.8 GHz). Thus, based on the illustrated equation: TRX2=3×(1−k)×(PS phasing), the maximum phase of radio signal TRX2 relative to radio signal TRX1 is 285° (i.e., 3×95°).

In FIG. 7C, a table is provided that illustrates the pre-tilt and fixed cabling delays associated with Ele1, at the top of the column 70, through Ele12, at the bottom of the column 70. And, on the right side of FIG. 7C, three tables are provided. These tables illustrate that for k=0.0, 0.5 and 1.0, which correspond to the first, second and third states of the phase shifters 74*a*, 74*b*, the radio signal TRX2 should be delayed (relative to TRX1) by: 285° (11° tilt), 142.5° (6° tilt) and 0° (1° tilt), to achieve the benefits described hereinabove (e.g., sidelobe suppression).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A base station antenna, comprising:

at least a first column of radiating elements configured to include: (i) a first plurality of physical rows of radiating elements, which are collectively operable as a first logical row of radiating elements responsive to a first radio frequency signal (RF1), and (ii) a second plurality of physical rows of radiating elements, which are collectively operable as a second logical row of radiating elements responsive to a second radio frequency signal (RF2), said radiating elements within both the first column and the first logical row comprising:

a first plurality of radiating elements responsive to RF1; and a second plurality of radiating elements responsive to a phase delayed version of RF1 generated by a first adjustable phase shifter; and a radio frequency (RF) signal generator configured to adjust a phase of RF2 relative to a phase of RF1, in response a change in a phase delay provided by the first adjustable phase shifter.

2. The antenna of claim 1, wherein responsive to the change in the phase delay, said RF signal generator adjusts the phase of RF2 relative to RF1 to thereby cause a change static electric tilt associated with said at least a first column of radiating elements.

3. The antenna of claim 2, wherein said RF signal generator is configured to adjust the phase of RF2 relative to RF1 in response to receiving a feedback signal indicating an updated phase delay state of the first adjustable phase shifter.

4. The antenna of claim 3, wherein said RF signal generator comprises a radio and baseband processor coupled to the radio; wherein the feedback signal is provided to the baseband processor; and wherein the radio generates RF2 having the adjusted phase in response to an updated control signal generated by the baseband processor.

5. The antenna of claim 2, wherein the phase of RF2 relative to RF1 is a function of: (i) a programmable tilt factor "k", which specifies a desired degree of the static electric tilt associated with said at least a first column of radiating elements, and (ii) a phasing coefficient "$P_c$", which specifies a magnitude of a phase delay that can be provided by the first adjustable phase shifter.

6. The antenna of claim 2, wherein the phase of RF2 relative to RF1 is a function of: (i) a programmable tilt factor "k", which specifies a desired degree of the static electric tilt associated with said at least a first column of radiating elements, (ii) a phasing coefficient "$P_c$", which specifies a magnitude of a phase delay that can be provided by the first adjustable phase shifter; and (iii) a multiplier "M", having a magnitude greater than one.

7. The antenna of claim 6, wherein M is an integer greater than one.

8. The antenna of claim 7, wherein $P_c$ is in a range from 140° to 160°.

9. The antenna of claim 8, wherein the phase of RF2 relative to RF1 is equivalent to: $k \times M \times P_c$.

10. The antenna of claim 8, wherein the phase of RF2 relative to RF1 is equivalent to: $k \times M \times P_c$, where M=2.

11. The antenna of claim 8, wherein the phase of RF2 relative to RF1 is equivalent to $(1-k) \times M \times P_c$, where M=3.

12. The antenna of claim 6, wherein $P_c$ specifies the magnitude of a maximum phase delay that can be provided by the first adjustable phase shifter.

13. The antenna of claim 1, wherein the first plurality of physical rows of radiating elements includes 2N consecutive physical rows of radiating elements within the first column, where N is a positive integer greater than one; wherein the second plurality of radiating elements span consecutive rows 1 through N; wherein the first plurality of radiating elements span consecutive rows N+1 through 2N; and wherein the Nth and N+1th physical rows are immediately adjacent rows.

14. The antenna of claim 13, wherein the antenna is configured so that each of the first plurality of radiating elements and each of the second plurality of radiating elements has a respective pre-tilt phase delay associated therewith.

15. The antenna of claim 14, wherein the pre-tilt phase delay associated with the N+1th radiating element in the first column is greater than the pre-tilt phase delay associated with the Nth radiating element in the first column.

16. The antenna of claim 1, wherein said radiating elements within both the first column and the second logical row, comprise: a third plurality of radiating elements responsive to RF2; and a fourth plurality of radiating elements responsive to a phase delayed version of RF2 generated by a second adjustable phase shifter.

17. A base station antenna, comprising:

at least a first column of radiating elements configured to include: (i) a first plurality of physical rows of radiating elements, which are collectively operable as a first logical row of radiating elements responsive to a first radio frequency signal (RF1), and (ii) a second plurality of physical rows of radiating elements, which are collectively operable as a second logical row of radiating elements responsive to a second radio frequency signal (RF2), said radiating elements within both the first column and the first logical row comprising:

a first plurality of radiating elements responsive to RF1; and a second plurality of radiating elements responsive to a phase delayed version of RF1 generated by a first adjustable phase shifter; and a radio frequency (RF) signal generator configured to adjust a phase of RF2 relative to a phase of RF1, in response a change in a phase delay provided by the first adjustable phase shifter;

wherein responsive to the change in the phase delay, said RF signal generator adjusts the phase of RF2 relative to RF1 to thereby cause a change static electric tilt associated with said at least a first column of radiating elements;

wherein the phase of RF2 relative to RF1 is a function of: (i) a programmable tilt factor "k", which specifies a desired degree of the static electric tilt associated with said at least a first column of radiating elements, and (ii) a phasing coefficient "$P_c$", which specifies a magnitude of a phase delay in a range from 140° to 160°, which can be provided by the first adjustable phase shifter.

18. The antenna of claim 17, wherein the first plurality of physical rows of radiating elements includes 2N consecutive physical rows of radiating elements within the first column, where N is a positive integer greater than one; wherein the second plurality of radiating elements span consecutive rows 1 through N; wherein the first plurality of radiating elements span consecutive rows N+1 through 2N; and wherein the Nth and N+1th physical rows are immediately adjacent rows.

19. The antenna of claim 18, wherein the antenna is configured so that each of the first plurality of radiating elements and each of the second plurality of radiating elements has a respective pre-tilt phase delay associated therewith.

20. The antenna of claim 19, wherein the pre-tilt phase delay associated with the N+1th radiating element in the first column is greater than the pre-tilt phase delay associated with the Nth radiating element in the first column.

* * * * *